United States Patent [19]

Lindsey et al.

[11] 4,093,183

[45] June 6, 1978

[54] UNITARY GROUNDING ASSEMBLY FOR BUNDLE CONDUCTOR STRINGING BLOCKS

[75] Inventors: Keith E. Lindsey, Pasadena; Hoyt W. Bozeman, Jr., Glendora, both of Calif.

[73] Assignee: Lindsey Manufacturing Company, Azusa, Calif.

[21] Appl. No.: 809,409

[22] Filed: Jun. 23, 1977

[51] Int. Cl.[2] ..... B66D 1/36

[52] U.S. Cl. ..... 254/134.3 PA

[58] Field of Search ..... 254/134.3 PA, 134.3 R, 254/192; 174/5-7

[56] References Cited

U.S. PATENT DOCUMENTS

| | | | |
|---|---|---|---|
| 3,545,724 | 12/1970 | Wright | 254/134.3 PA |
| 3,565,401 | 2/1971 | Green | 254/134.3 PA |
| 3,720,399 | 3/1973 | Bozeman, Jr. | 254/134.3 PA |
| 3,844,536 | 10/1974 | Chadwick, Jr. | 254/134.3 PA |

*Primary Examiner*—Robert C. Watson

*Attorney, Agent, or Firm*—Sellers and Brace

[57] ABSTRACT

A unitary grounding assembly for pivoting attachment astride a bundle conductor stringing block and provided with grounding rollers biased against the underside of the conductors. The legs of a roller supporting bracket are resilient and constructed to twist lengthwise thereof to accommodate differential sag of the conductors and to maintain the rollers in pressurized electrical contact with a respective one of the conductors.

6 Claims, 4 Drawing Figures

UNITARY GROUNDING ASSEMBLY FOR BUNDLE CONDUCTOR STRINGING BLOCKS

This invention relates to electrical grounding assemblies, and more particularly to an improved unitary self-contained device designed to straddle the sheaves of a bundle conductor stringing block having means flexibly supporting rollers in pressurized contact with the bundle conductors despite widely differing sag conditions of these conductors.

The multiple conductors of a bundle type power conductor are pulled into position along a power line by the aid of stringing blocks suspended from the lower ends of the power line insulator. One of the serious hazards associated with this operation involves the possibility of high electrical charges on the conductors capable of seriously injuring if not killing workmen engaged in the stringing operation. These charges can originate from any one of many sources including contact with other live electrical conductors, static charges generated during installation, lightning, and the like. To safeguard against these hazards it has been proposed to provide the blocks with conductive devices maintained in contact with the conductors undergoing installation and connected to ground by suitable cabling.

Grounding devices for bundle conductors during installation present special problems because the two or more power conductors thereof are strung simultaneously and the conductors thereof invariably exhibit different sag conditions between adjacent stringing blocks. If the grounding rollers for the several conductors are supported on a common shaft, the conductor having the greater sag is likely to hold the grounding rollers for one or more of the remaining conductors either out of contact or in light and unreliable grounding contact therewith. Grounding devices heretofore proposed to cope with this problem include Bozeman Pat. No. 3,720,399 and Chadwick Pat. No. 3,844,536. Each is subject to certain disadvantages and shortcomings avoided by this invention. The Bozeman patent mounts the several grounding rollers on a common shaft the ends of which are pivotally connected within conical bores crosswise of the outer ends of supporting arms by a pin passing diametrically through the shaft with its ends socketed in a respective supporting arm. This not only provides a sloppy assembly when not installed in a stringing block but has very poor mechanical strength characteristics at the pin connection between the shaft and the supporting arms therefor. The electrical path is also inadequate and unreliable with the result that a flexible bonding connection is required between the shaft and at least one of the supporting arms. The Chadwick construction is subject to each of these advantages and, in addition, proposes mounting adjacent pairs of grounding rollers in off-set eccentric relationship in an effort to equalize the grounding pressure between a pair of adjacent bundle conductors.

This invention provides a self-contained unitary grounding assembly for bundle conductors avoiding the foregoing and other disadvantages of prior grounding devices. The opposite end of a common shaft for the grounding rollers is mounted in separate long bearings providing excellent electrical contact with the shaft and which bearings are rigidly bolted to specially designed long flexible supporting arms or legs. The opposite ends of these legs are clamped to bearing members pivotally mounted in separate fixtures rigidly securable to the side frames of the stringing block closely adjacent the sheave axis. Each of the roller supporting legs includes a pair of long strip springs lying at right angles to one another and strongly resisting flexure in their respective planes but offering substantial but very appreciably less resistance to twisting through a limited arc lengthwise of the legs. This unique feature permits the roller supporting end of the main body to tilt or twist out of its normal horizontal operating plane sufficiently to accommodate differential sag of the conductors. The leaves of cantilever leaf springs are arranged to bias the rollers into the requisite degree of pressure contact with an associated one of the bundle conductors. The legs of the main body are also provided with a series of holes permitting assembly of the roller shaft at different distances from the pivot axis of the grounding assembly to accommodate the device to stringing blocks of different sizes.

A primary object of the invention is the provision of an improved simply-constructed, rugged but flexible grounding assembly for use on bundle conductor stringing blocks sufficiently flexible and distortable to compensate for differential sag of the conductors of a bundle conductor.

Another object of the invention is the provision of a unitary grounding accessory readily assembled astride a bundle conductor stringing block and having flexible roller supporting arms cooperating to compensate for differential conductor sag while maintaining firm pressurized contact between each roller and an associated conductor of a bundle conductor.

Another object of the invention is the provision of a grounding assembly attachable as a unit to bundle conductor stringing blocks having a common shaft for the grounding rollers with the ends thereof journalled in axially-long bearings rigidly connected to resilient supporting legs having limited rotary flexibility about the length thereof.

These and other more specific objects will appear upon reading the following specification and claims and upon considering in connection therewith the attached drawing to which they relate.

Referring now to the drawing in which a preferred embodiment of the invention is illustrated:

Figure 1:
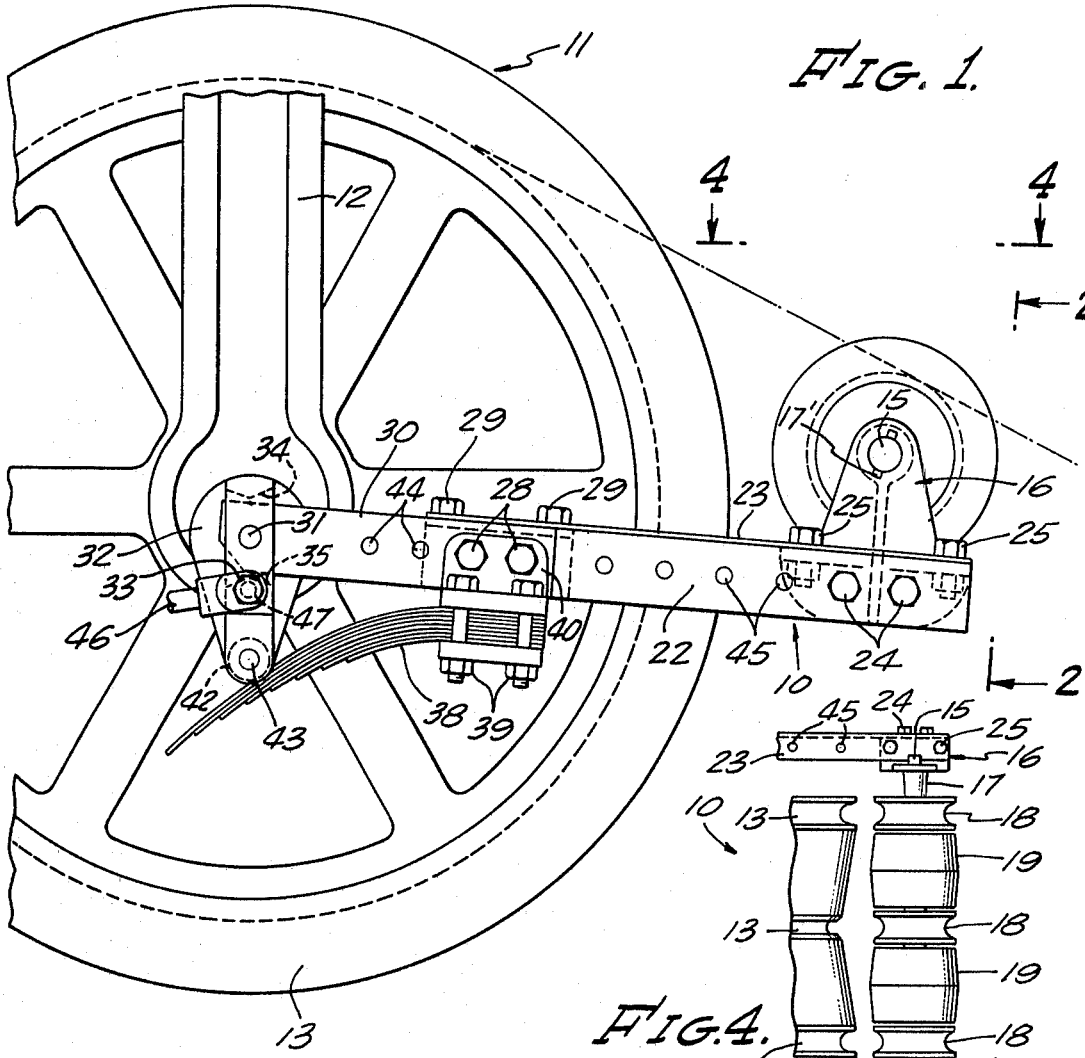
FIG. 1 is a fragmentary side elevational view of a typical conventional bundle conductor stringing block having an illustrative embodiment of the invention grounding accessory assembled thereto and positioned as though supporting a deeply sagging bundle conductor.
Figure 4:
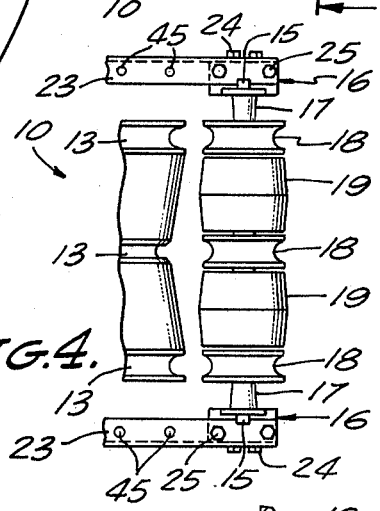
Figure 2:
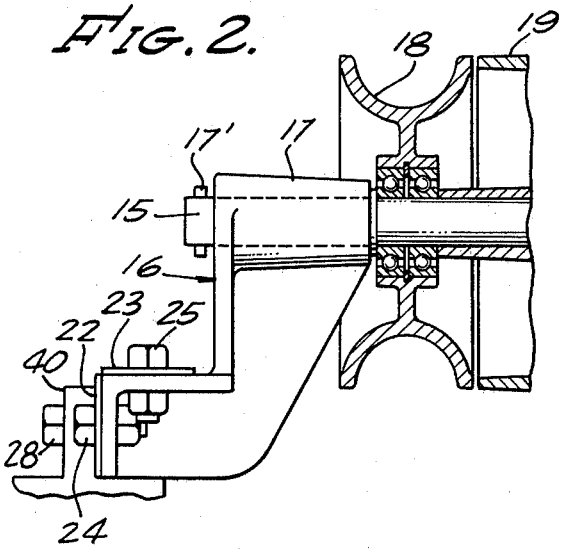
FIG. 2 is a fragmentary view on an enlarged scale and partly in section as viewed generally along line 2—2 on FIG. 1 and showing the shaft in a normal horizontal position.
Figure 3:
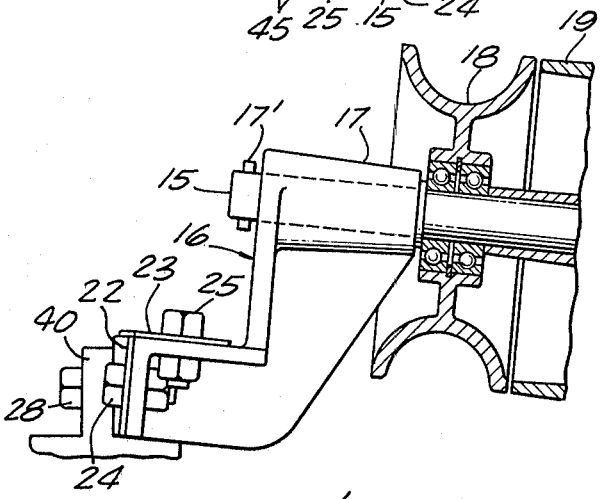

FIG. 3 is a view similar to FIG. 2 but showing the roller supporting shaft canted downwardly to the right and clockwise thereby indicating that a conductor supported on the roller at the unshown right hand end of the shaft is sagging substantially more than a bundle conductor supported on the roller at the left hand end of the shaft; and FIG. 4 is a fragmentary top plan view on a smaller scale and taken along line 4—4 on FIG. 1.

Referring initially more particularly to FIGS. 1 and 4, there is shown an illustrative embodiment of a unitary grounding assembly, designated generally 10, having a U-shaped main body sized to be assembled astride a conventional bundle conductor stringing block designated generally 11. This stringing block is of well known construction such as that described in the co-pending application Ser. No. 603,631, filed Aug. 11, 1975 of Keith E. Lindsey, one of the co-inventors of this invention. Such blocks commonly have suspension side frames 12 interconnected to the ends of a shaft, not shown, but supporting a plurality of sheaves 13 in closely spaced side by side relation as is indicated in FIG. 4. The upper ends of side frames 12,12 may be interconnected by a suspension yoke or may be suspended directly from the lower end of an insulator or some overlying part of a power line tower structure associated therewith.

The ends of the shaft 15 supporting the grounding rollers are journalled in brackets 16 equipped with a long axial bearing 17, the shaft being held assembled in bearings 17 by a frictionally-retained keeper pin 17'. The portion of shaft 15 between bearings 17 is occupied by a separate roller 18 for each conductor and are held aligned with an associated one of sheaves 13 by a spacer roller 19.

The legs of the U-shaped main body of assembly 10 are formed in major part of separate long strips of spring steel or the like 22,23 best shown in FIGS. 1, 2 and 3. These two strips are shown as lying in planes at right angles to one another with one pair of their adjacent edges closely spaced parallel to one another, although this spacing is not an important feature. The outer ends of these strips are rigidly secured by bolts 24,25 to the left hand end of bracket 16 in the manner shown in FIGS. 2 and 3. The other end of spring strips 22,23 are similarly bolted by bolts 28,29 to an appropriately shaped member 30 the left hand of which, as viewed in FIG. 1, is pivotally supported on a pivot pin 31 carried by a mounting member 32 rigidly clamped by a fastener 33 to the outer face of the stringing block side frame 12. The pivot pin 31 may extend inwardly beyond the inner face of mounting member 32 and into a well formed in side frame 12 thereby cooperating with the mounting fastener 33 in securing the grounding assembly astride the stringing block in an area closely adjacent the axis of its sheave-supporting shaft.

Mounting member 32 is formed with a transverse slot extending transversely of pivot pin 31 and loosely receiving the adjacent end portion of member 30. The opposite ends of this slot are provided with stop surfaces 34,35 cooperating with the adjacent upper and lower edges of member 30 to limit the pivotal movement of the main body of grounding assembly 10 about the axis of pivot pins 31. Normally, the main body of assembly 10 operates generally within the upper right hand quadrant of the stringing block as viewed in FIG. 1 and within the limits permitted by stop surfaces 34,35. For example, the upper sides of the grooves in rollers 18 usually operate in an arc the upper side of which is approximately 15° below a horizontal plane tangent to the uppermost portion of the grooves in sheaves 18 and the lowermost position of which is approximately 60° below this horizontal plane tangent to the sheaves.

The grounding assembly 10, as here shown, is biased upwardly so that rollers 18 apply a suitable contact pressure of say 35 lbs. against the underside of a conductor resting thereon. As herein shown such biasing means comprises a multileaf cantilever spring 38 clamped by bolts 28 and 39 and the L-shaped bracket 40 to members 30 along either side of the stringing block. As shown in FIG. 1 by way of illustration, the free ends of spring leaves 38 bear against a roller 42 supported on a pivot pin 43 carried by mounting members 32 holding the grounding assembly installed to the stringing block side frames 12. The leaves 38 vary in length and are arranged in echelon as clearly shown in FIG. 1 and, in consequence, the stiffness of the spring increases as the load on rollers 18 increases thereby pivoting assembly 10 counterclockwise as viewed in FIG. 1.

The strength and effectiveness of springs 38 can be varied both by varying the number and strength of the individual leaves as well as by adjusting the spring supporting bracket 40 lengthwise of member 30 by selecting one of several sets of mounting holes 44 for the bolts 28, holding the spring assembled to the legs of the grounding assembly. Likewise, the outer ends of the spring strips 22,23 are preferably provided with a series of mounting holes 45 for bolts 24,25. This permits the user to mount the roller supporting brackets 16,16 at the proper distance from pivot pin 31 as necessary for the use of assembly 10 on stringing blocks of different sizes as respects the diameter of its sheaves.

It will be understood that all components of grounding assembly 10 are formed of electrically conductive material and that the assembly is suitably connected to ground by a heavy lead wire. Such a lead wire 46 is shown in FIG. 1 as attached to an extension 47 of bolt 33 but it will be understood that the ground wire may be suitably connected to some other component of assembly 10.

Preparatory to use, grounding assembly 10 is installed astride a stringing block 11 using the two bolts 33 to clamp the associated coupling member 32 to the respective block side frames 12. No other assembly operation is required with the exception of attaching the grounding cable 46 to the outer end 47 of bolt 33. Prior to threading the conductors of a bundle conductor through the stringing block, springs 38 are effective to hold the main body and rollers 18 of assembly 10 pivoted counterclockwise to an elevated position with rollers 18 lying in a horizontal plane tangent to the top side of sheaves 13. As soon as the bundle conductor is threaded through the stringing block the individual conductors rest in a respective one of sheaves 13 and in an associated one of the grounding rollers 18. The weight and sag of these conductors then act to pivot assembly 10 clockwise as viewed in FIG. 1 in opposition to springs 38 which act to maintain continuous pressurized contact between the rollers and the conductors. Typically, the sag of the different conductors varies despite the efforts to maintain constant tensile stress along each conductor. Referring to FIGS. 2 and 3, let it be assumed that the conductor on the roller adjacent the right hand end of shaft 15 sags more than the conductor in roller 18 at the left hand end of the shaft. This greater load at the right hand end of the shaft will cause outer ends of the resilient strips 22,23 to twist about an axis extending lengthwise thereof while cooperating with one another and with the cantilever springs 38 in maintaining all rollers in firm electrical contact with the conductors. FIG. 2 shows shaft 15 supported horizontally as it normally is, whereas FIG. 3 shows shaft 15 canted with the right hand end lower than the left hand end due to the fact that the cable in the right hand roller is sagging more than the conductor riding in the left hand roller 18. Along a length of the bundle conductor between adjacent towers of the power line.

As will be readily apparent from a consideration of FIGS. 2 and 3, resilient strips 22 normally lie in a vertical plane and highly resist flexining in this plane. Strips 23 however, lie in a plane at right angles to a vertical plane and strongly resist lateral movement of the grounding assembly crosswise of the plane of strips 23. However, each interconnected pair of strips 22,23 are relatively flexible to twisting or rotary movement about an axis extending lengthwise thereof. This characteristic of the assembly is utilized to compensate for differential sag between different conductors of a bundle conductor being strung along a power line. So long as the sag of the several conductors remains substantially equal, springs 38 cooperate with strips 22,23 in maintaining shaft 15 substantially horizontal. However, if the sag of the conductors differ, then this differential loading causes shaft 15 to tilt crosswise of the conductors and away from its normal horizontal plane to the degree necessary to compensate for the differential sag.

While the particular unitary grounding assembly for bundle conductor stringing blocks herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. A grounding assembly adapted to be pivotally mounted astride the frame of a bundle conductor stringing block comprising: a U-shaped main body having a pair of generally parallel legs interconnected crosswise of one end thereof by a shaft supporting a separate conductive roller for each conductor of a bundle conductor, the other ends of said legs including means for pivotally mounting said assembly on the opposite lateral sides of the frame of a bundle conductor stringing block, means for biasing said assembly to pivot in a direction to maintain said rollers in pressurized contact with the underside of a respective conductor of a bundle conductor supported by a stringing block, and said legs including resilient flexible portions permitting the roller-supporting ends of said legs to twist generally about the length thereof and said roller-supporting shaft to tilt away from the normally prevailing plane thereof to accommodate differential conductor sag conditions.

2. A grounding assembly as defined in claim 1 characterized in that said legs of said resilient portions of said legs are operable to strongly resist flexure of said legs in planes at right angles to one another and generally parallel to the length of said legs.

3. A grounding assembly as defined in claim 1 characterized in that said resilient portions of said legs comprise resilient strips lying generally at right angles to one another and rigidly interconnected at the respective adjacent ends thereof.

4. A grounding assembly as defined in claim 1 characterized in that said means biasing the rollers of said assembly against the underside of a respective bundle conductor comprises spring means having one end bearing against a midlength portion of said legs and the other end thereof bearing against means forming part of said grounding assembly and securable to the stringing block when said assembly is mounted thereon.

5. A grounding assembly as defined in claim 1 characterized in that the resilient portions of said legs include means for mounting said roller supporting shaft selectively at different distances from the pivotally supported ends of said legs thereby to accommodate said grounding assembly for use on stringing blocks of different sizes.

6. A grounding assembly adapted to be pivotally mounted on and astride the frame of a bundle conductor stringing block, said assembly having a U-shaped main body, the bight portion of said main body including a shaft supporting a separate roller for a respective conductor of a bundle conductor, the legs of said main body being generally parallel and each formed in major part of resilient flexible material and operable to strongly resist flexure in planes at right angles to one another and extending lengthwise of said legs but permitting limited twisting of said legs out of the normal plane thereof and generally about the length of said legs to accommodate differential sag of the conductors of a bundle conductor while resting on said rollers, bracket means for pivotally connecting the ends of said legs remote from said shaft to the opposite sides of the suspension frame of a bundle conductor stringing block, and means operatively associated with the legs of said main body for biasing said rollers against the underside of a bundle conductor.

* * * * *